US005662406A

United States Patent [19]

Mattice et al.

[11] Patent Number: 5,662,406

[45] Date of Patent: Sep. 2, 1997

[54] LIGHTED BABY BOTTLE

[76] Inventors: Johnny M. Mattice, 8200 Offenhauser Dr. 103-H; Elyse L. Mattice, 8200 Offenhauser Dr. 101-H, both of Reno, Nev. 89511

[21] Appl. No.: 596,082

[22] Filed: Feb. 6, 1996

[51] Int. Cl.[6] ..... F21V 33/00

[52] U.S. Cl. ..... 362/101; 362/253; 362/276; 362/802; 215/11.1; 215/228; 215/230

[58] Field of Search ..... 362/96, 101, 253, 362/276, 802; 215/11.1, 11.2, 11.3, 11.6, 228, 230

[56] References Cited

U.S. PATENT DOCUMENTS

| | | | |
|---|---|---|---|
| 2,582,781 | 1/1952 | Johnson | 362/101 |
| 2,663,866 | 12/1953 | Simpson | 362/101 |
| 3,593,871 | 7/1971 | Bundy et al. | 215/11.3 |
| 4,832,214 | 5/1989 | Schrader et al. | 215/11.1 |
| 4,836,476 | 6/1989 | Wolf | 362/101 |
| 4,895,327 | 1/1990 | Malone et al. | 248/102 |
| 4,930,902 | 6/1990 | Yata et al. | 215/11.2 |
| 4,944,418 | 7/1990 | Wallace | 215/376 |
| 5,016,845 | 5/1991 | Pellegrino | 248/104 |
| 5,044,509 | 9/1991 | Petrosky et al. | 362/101 |

*Primary Examiner*—Alan Cariaso
*Attorney, Agent, or Firm*—Chase & Yakimo

[57] ABSTRACT

A baby bottle having a bottle portion with a first proximal end and a second distal end relative a feeding baby, a nipple portion attached to the bottle portion at the proximal end, a light member for illuminating the bottle attached to the distal end of the bottle portion and an attachment member for attaching the light member to the bottle. The light member includes a light source, a main power switch and a power source, all electrically connected together and mounted within a protective housing. The light member may also include an angle sensitive switch for activating the light source when the bottle is not upright.

19 Claims, 7 Drawing Sheets

LIGHTED BABY BOTTLE

FIELD OF THE INVENTION

This invention relates to a baby bottle having a night light attachment which facilitates locating the bottle in the dark. Furthermore, the baby bottle's night light illuminates when the bottle is not upright, or in other words, has fallen over and is especially difficult to find in the dark.

BACKGROUND OF THE INVENTION

After feeding a baby, the bottles can be mistakenly left behind in the baby's nursery. Retrieval of bottles is difficult especially at night and when the baby is sleeping since the baby should not be disturbed by turning on the nursery light. It may also be preferable to feed a baby at night or in a darkened room without turning on the overhead light, which is typically quite bright.

SUMMARY OF THE INVENTION

Accordingly, a primary object of the subject invention is to provide a baby bottle having a light member for illuminating the bottle, including a light source electrically connected to a power source.

Another object of the subject invention is to provide a baby bottle having a light member which further includes a power switch electrically connected to the light source and the power source for selectively activating the light source.

Yet another object of the subject invention is to provide a baby bottle having a light member that further includes an angle sensitive activation switch electrically connected to the light source and the power source for activating the light source when the bottle is not upright.

A further object of the subject invention is to provide a baby bottle having a light member attached to the distal end of the bottle relative the baby and mounted within a housing to prevent the baby from being shocked.

Still a further object of the subject invention is to provide a baby bottle having a light member powered by an easily replaceable battery.

Yet a further object of the subject invention is to provide a baby bottle having a light member that is relatively inexpensive to manufacture and easy to use.

These objects are attained by providing a baby bottle having a bottle portion with the first proximal end and a second distal end relative a feeding baby, a nipple attached to the bottle portion at the proximal end, a light member for illuminating the bottle attached to the distal end of the bottle portion and an attachment member for attaching the light member to the bottle. The light member includes a light source, a main power switch and a power source, all electrically connected together and mounted within a protective housing. The light member may also include an angle sensitive switch for activating the light source when the bottle is not upright.

Other objects and advantages of this invention will become apparent from the following description taken in connection with the accompanying drawings, wherein is set forth by way of illustration and example, an embodiment of this invention.

DETAILED DESCRIPTION

Figure 1:
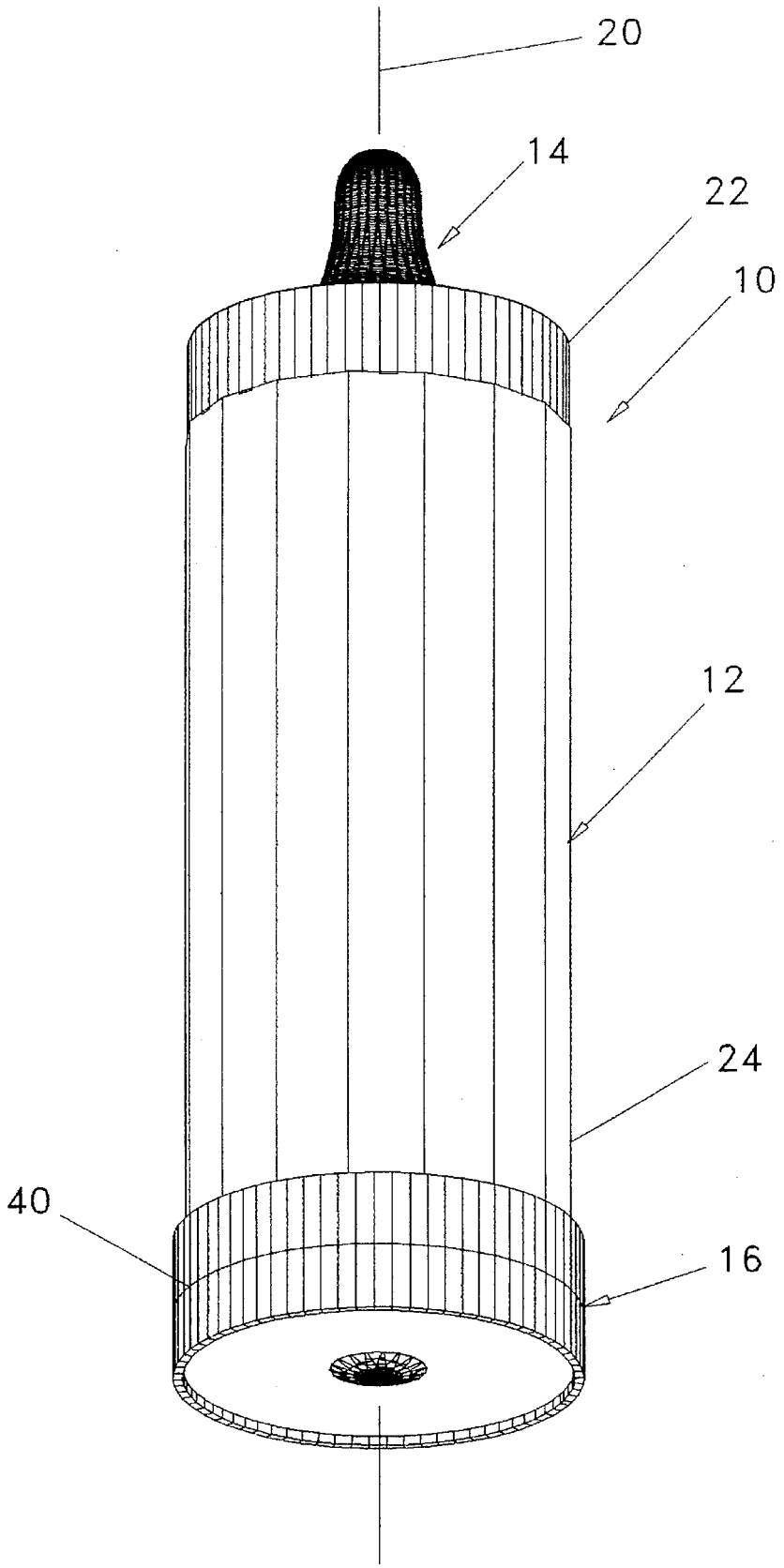
FIG. 1 is a front perspective view of a baby bottle in accordance with the present invention.

Baby bottle 10, as seen in FIG. 1, includes bottle portion 12, nipple portion 14 and night light member 16. Light member 16 illuminates bottle 10 at night or in a darkened room to facilitate the retrieval of bottle 10 without disturbing a sleeping baby. Light member 16 can also be activated during a nighttime feeding instead of a bright, overhead light.

Bottle portion 12 is typically formed of plastic or glass and forms a container from which a baby drinks its formula or other feeding liquid. Bottle portion 12 is preferably substantially cylindrical and extends along longitudinal axis 20, as seen in FIG. 1, from first proximal end 22 to second distal end 24 relative a feeding baby. First end 22 is open for pouring the baby's formula or other liquid into bottle portion 12. Second end 24 of bottle portion 12 is closed so that the formula or other liquid is contained therein once nipple portion 14 is secured to bottle portion 12.

Figure 2:
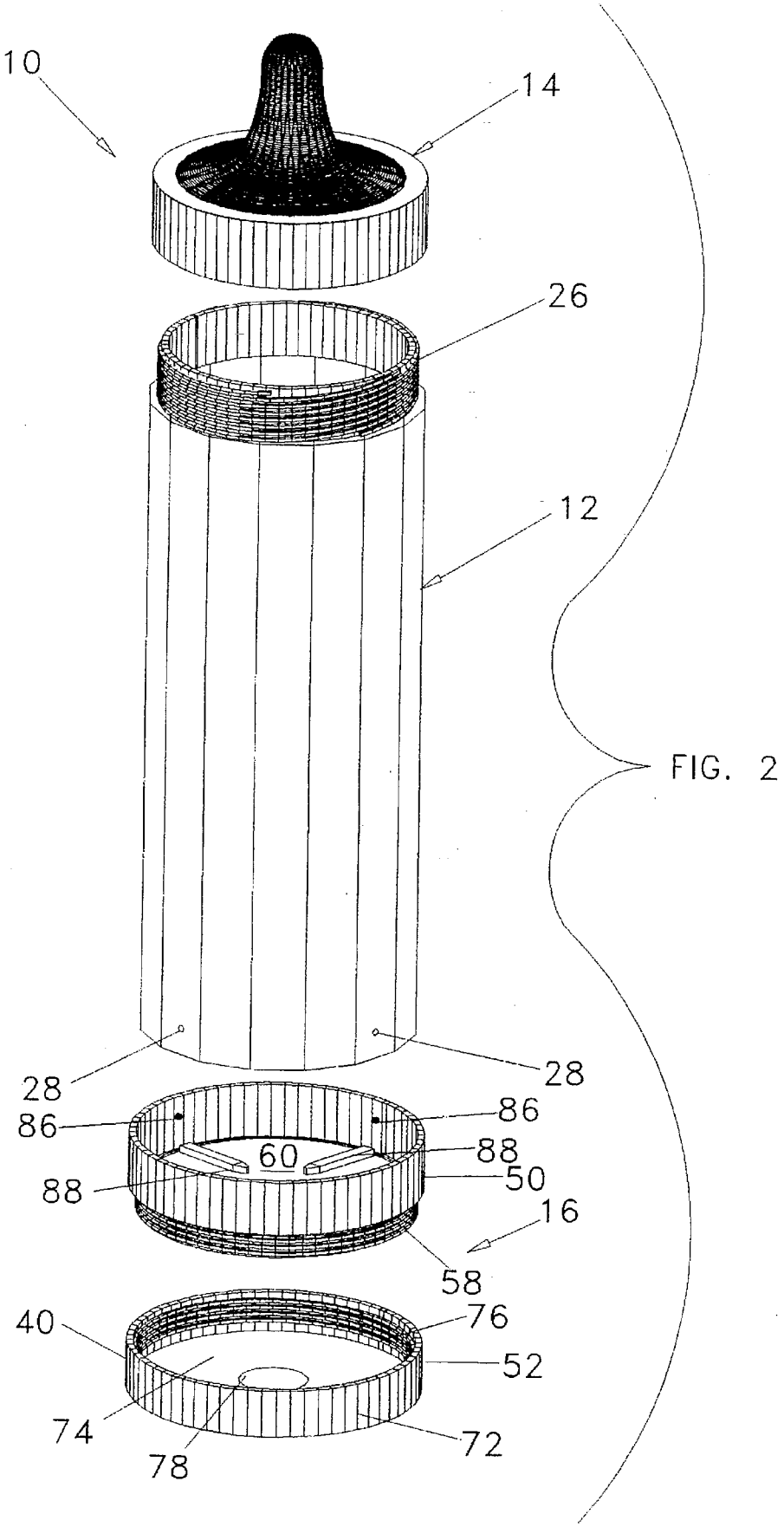
FIG. 2 is an exploded view of the bottle of FIG. 1.

Bottle portion 12 includes a threaded neck 26 formed at first end 22 for receiving and attaching the nipple portion 14 thereto, as seen in FIG. 2. Bottle portion 12 also includes attachment grooves 28 formed adjacent distal end 24 to which light member 16 attaches. Preferably, bottle portion 12 includes four evenly spaced apart attachment grooves 28. Two grooves 28 as formed in the outer surface of bottle portion 12 are shown in FIG. 2.

Nipple portion 14 rotatably attaches to threaded neck 26 of bottle portion 12 at first proximal end 22, as seen in FIGS. 1 and 2. While feeding, the baby sucks on the end of nipple portion 14 to withdraw the feeding liquid from within bottle portion 12. Nipple portion 14 may be formed similar to any conventional nipple.

Light member 16 includes housing 40, light 42, battery 44, main power switch 46 and angle sensitive switch or fluctuating elevational switch 48. Housing 40 includes two chambers 50 and 52, as seen in FIGS. 2–5.

Figure 4:
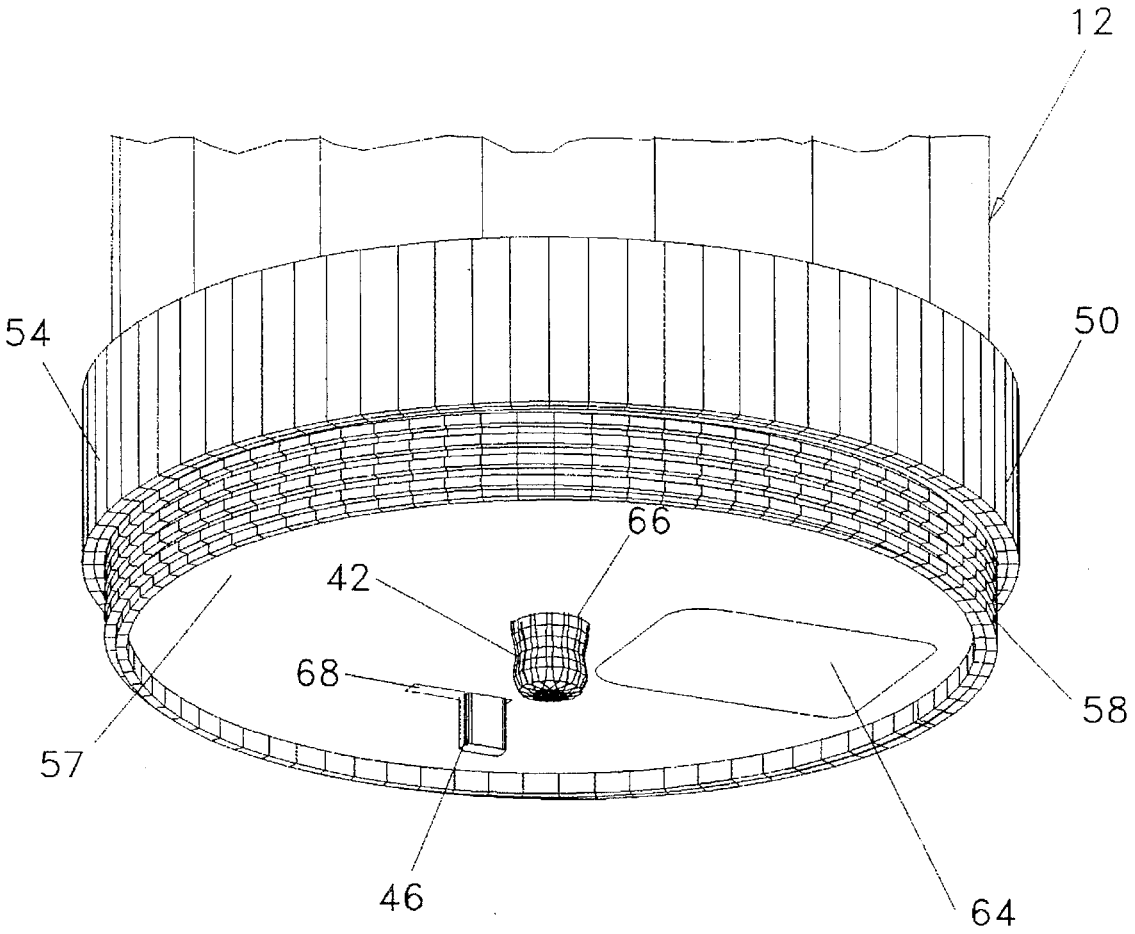
FIG. 4 is a fragmentary view of the bottle end of FIG. 3 showing the light source and main power switch extending into the second chamber of the housing.
Figure 5:
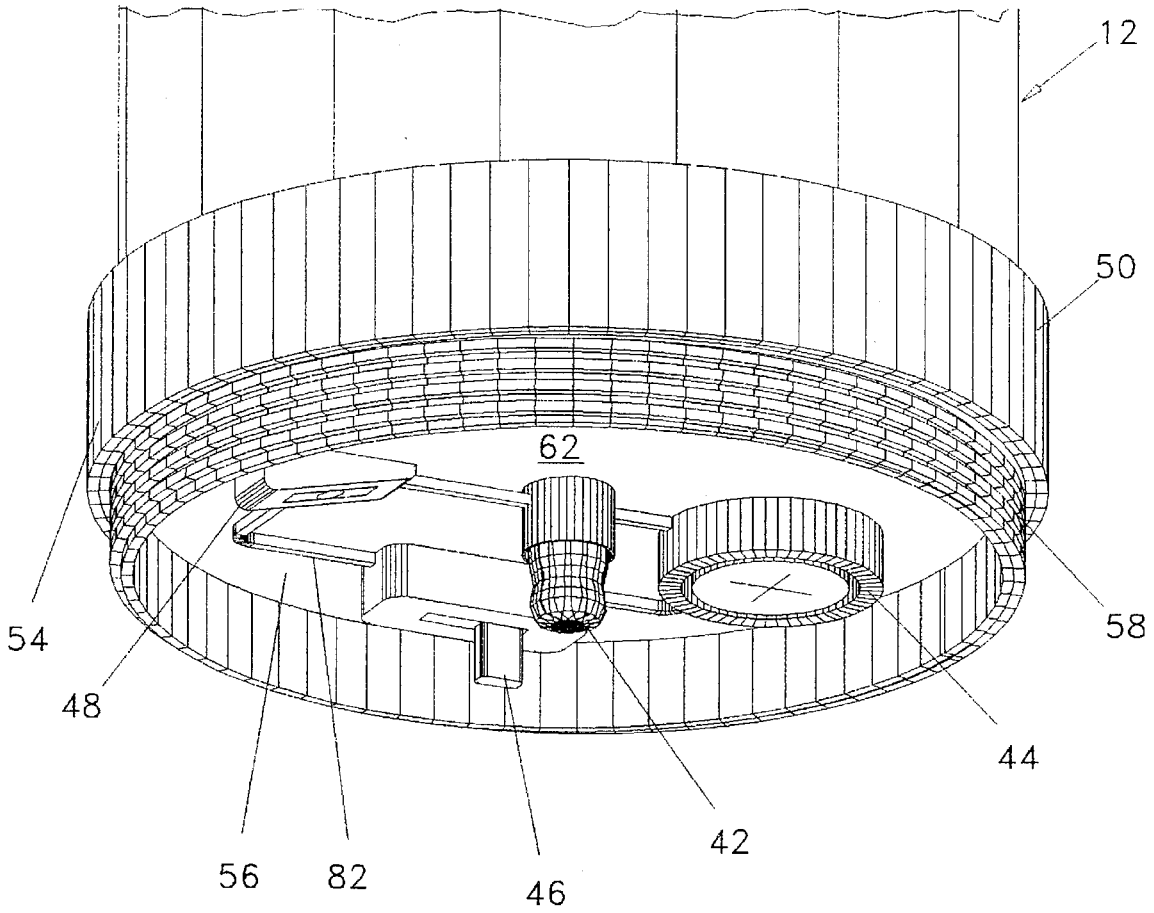
FIG. 5 is a fragmentary view of the bottle end of FIG. 3 showing the light member mounted in the first chamber of the housing.
Figure 6:
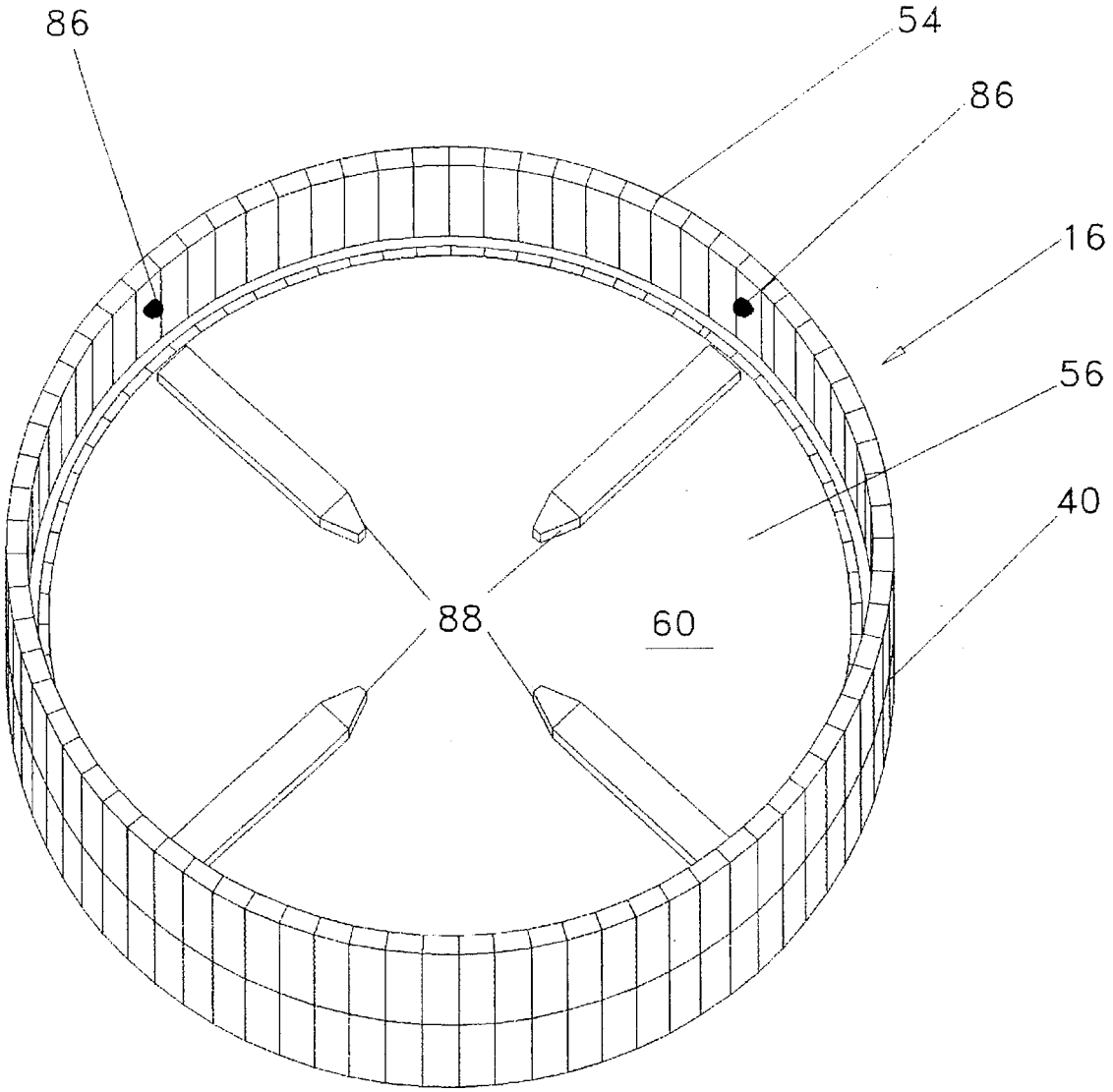
FIG. 6 is a perspective view of the housing of the bottle of FIG. 1 showing the attachment member thereof.

First chamber 50 attaches to distal end 24 of bottle portion 12 at attachment grooves 28 and includes cylindrical side wall 54, mounting plate 56, cover plate 57 and threaded neck 58, as seen in FIGS. 4–6. Mounting plate 56 and cover plate 57 are spaced apart with mounting plate 56 above cover plate 57. Mounting plate 56 extends continuously between side wall 54 and attaches substantially at the junction of side wall 54 and threaded neck 58 (FIG. 6). Mounting plate 56 further includes a first or top surface 60, as in FIG. 6, and a second or bottom surface 62, as in FIG. 5. Cover plate 57 extends between threaded neck 58, as seen in FIG. 4. Cover plate 57 includes battery access door 64, aperture 66 through which light 42 extends and main switch access 68 through which power switch 46 extends. Threaded neck 58 extends outwardly and downwardly from side wall 54, as seen in FIGS. 4 and 5.

Figure 3:
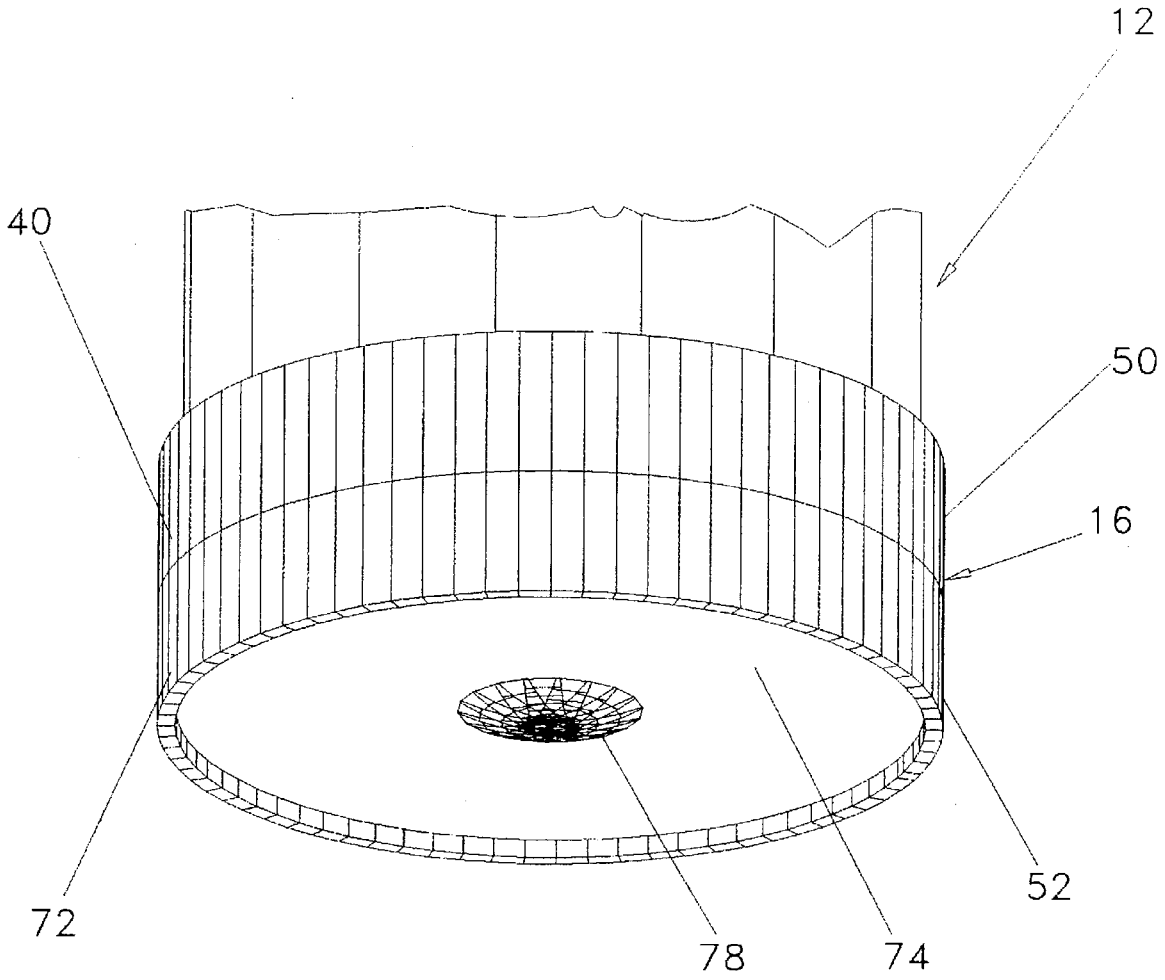
FIG. 3 is a fragmentary view of the distal end of the bottle of FIG. 1, on an enlarged scale, showing the light member's housing.

Second chamber 52 includes cylindrical side wall 72 and cover plate 74, as seen in FIGS. 2 and 3. Side wall 72 includes interior threads 76 which threadably mate with threaded neck 58 of first chamber 50 to rotatably attach second chamber 52 to first chamber 50. Thus, second chamber 52 is easily attachable to and removable from first chamber 50 to allow easy access to main power switch 46 and also for replacing battery 44 and light 42, as shown by FIGS. 3 and 4. Cover plate 74 extends between the bottom edge of side wall 72. Cover plate 74 includes transparent light cover 78 which aligns with light 42 along axis 20 when assembled. Cover plate 74 forms the bottom or distal-most end of bottle 10 relative a feeding baby. Light cover 78 protects light 42 and is preferably tinted red to allow a soft red glow to radiate from housing 40.

Housing 40 attaches to the distal end 24 of bottle portion 12 by snapping raised lugs 86 into grooves 28 of bottle portion 12 as best seen in FIGS. 2 and 6. Raised lugs 86 extend outwardly and inwardly toward axis 20 from side wall 54 of first chamber 50 to mate with grooves 28. Flexible pads 88 also extend from side wall 54 of first chamber 50 inwardly toward axis 20 and are mounted to top surface 60 of mounting plate 56. Flexible pads 88 are preferably equally spaced apart, one being in alignment with each one of raised lugs 86. Flexible pads 88 are preferably formed of a foam or rubber type material and allow for a secure fit of light member 16 to bottle portion 12.

Light 42, battery 44, main switch 46 and angle sensitive switch 48 are electrically connected via electric wiring 82 as shown in FIG. 5 and are mounted to bottom surface 62 of mounting plate 56 within first chamber 50 of housing 40. Light 42 is preferably an incandescent light bulb or an LED source. Battery 44 is preferably a microvoltage battery.

Figure 7:
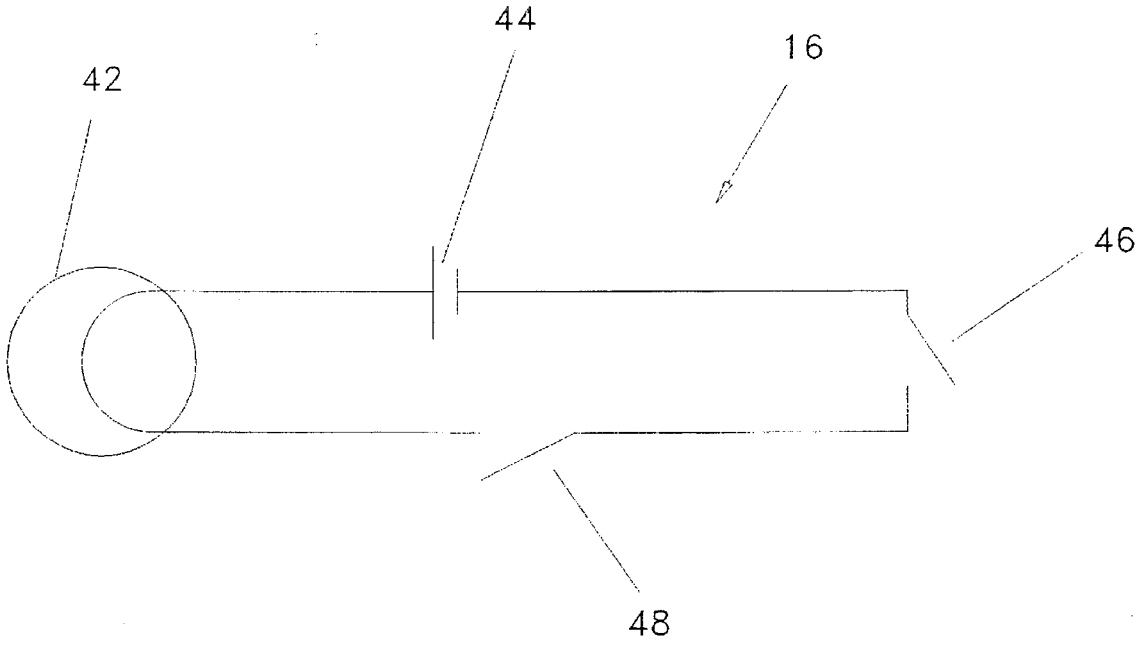
FIG. 7 is a circuit schematic utilized in accordance with the present invention.

FIG. 7 shows light 42, battery 44, main switch 46 and angle sensitive switch 48 schematically, with switches 46 and 48 in their off position. To activate light 42, main power switch 46 must be manually switched to its on position. This is done by removing chamber 52 from chamber 50 and pivoting switch 46 from its off position, shown in FIG. 4, to its on position. Additionally, angle sensitive switch 48, which senses changes in the position of bottle 10, must be moved to its on position so as to close the circuit.

Angle sensitive switch 48 is open when the bottle 10 is angled for feeding and closed when the bottle 10 is lying flat on its side. This switch 48 is especially helpful in locating a bottle that has fallen over or been left in an overturned position in a darkened room. Alternatively, angle sensitive switch 48 can be designed to be closed at any angle thus allowing light 42 to be activated during feeding. Finally, switch 48 need not be utilized, the light 42 being activated only by main power switch 46. In this case, light 42 will continuously illuminate bottle 10 until switch 46 is moved to its off position.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A baby bottle, comprising:

a bottle having a first proximal end relative a feeding baby and a second distal end relative the baby;

a light means for illuminating the bottle, including a light source electrically connected to a power source; and attachment means for attaching said light means to said bottle.

2. A baby bottle as claimed in claim 1, wherein said light means attaches to said distal end of said bottle.

3. A baby bottle as claimed in claim 1, wherein said light means includes a switch means electrically connected between said light source and said power source for selectively activating said light source.

4. A baby bottle as claimed in claim 1, wherein said light means includes a switch means electrically connected between said light source and said power source and including structure for closing said switch means at a selected inclination of the bottle, whereupon said switch means activates said light source when the bottle is at said selected inclination.

5. A baby bottle as claimed in claim 4 wherein said selected inclination is when said bottle is tilted from an upright position relative to a support surface.

6. A baby bottle as claimed in claim 1, wherein said light means includes a housing in which said light source and said power source are mounted, said housing having a transparent portion which extends over said light source.

7. A baby bottle as claimed in claim 1, wherein said light source is a light bulb and said power source is a microvoltage battery.

8. A baby bottle, comprising:

a bottle portion having a first proximal end relative a feeding baby and a second distal end relative the baby;

a light means for illuminating the bottle; and attachment means for attaching said light means to said bottle portion;

said light means including a light source and a power switch electrically connected to a power source, said power switch selectively activating said light source.

9. A baby bottle as claimed in claim 8 wherein said power switch includes structure for closing said switch at a selected inclination of the bottle, whereupon said switch activates said light source when the bottle is at said selected inclination.

10. A baby bottle as claimed in claim 9, wherein said selected inclination is when said bottle is tilted from an upright position relative to a support surface.

11. A baby bottle as claimed in claim 8, wherein said light means attaches to said distal end of said bottle portion.

12. A baby bottle as claimed in claim 8, wherein said light means includes a housing in which said light source, said power switch and said power source are mounted, said housing having a transparent portion which extends over said light source.

13. A baby bottle, comprising:

a bottle portion having a first proximal end relative a feeding baby and a second distal end relative the baby;

a nipple member attached to said bottle portion;

a light means for illuminating the bottle; and attachment means for attaching said light means to said bottle portion;

said light means including a light source, a main power switch and a power source, all electrically connected together;

said power switch for selectively activating said light source.

14. A baby bottle as claimed in claim 13, wherein said switch includes structure for closing said switch at a selected inclination of the bottle, whereupon said switch activates said light source when the bottle is at said selected inclination.

15. A baby bottle as claimed in claim 14, wherein said selected inclination is when said bottle is tilted from an upright position relative to a support surface.

16. A baby bottle as claimed in claim 15, wherein said light means includes a housing in which said light source, said power switch and said power source are housed.

17. A baby bottle as claimed in claim 16, wherein said light source is a light bulb and said power source is a microvoltage battery.

18. A baby bottle as claimed in claim 17, wherein said nipple attaches to said proximal end of said bottle portion and said light means attaches to said distal end of said bottle portion.

19. A baby bottle as claimed in claim 18, wherein said housing includes a transparent light cover which extends over said light source.

* * * * *